US012680739B2

(12) United States Patent
Chere

(10) Patent No.: US 12,680,739 B2
(45) Date of Patent: Jul. 14, 2026

(54) DEICING AND ICING PREVENTION SYSTEM FOR ADVANCE CYCLE CONDENSERS

(71) Applicant: RTX Corporation, Farmington, CT (US)

(72) Inventor: Gregory M. Chere, Glastonbury, CT (US)

(73) Assignee: RTX Corporation, Farmington, CT (US)

( * ) Notice: Subject to any disclaimer, the term of this patent is extended or adjusted under 35 U.S.C. 154(b) by 189 days.

(21) Appl. No.: 18/731,105

(22) Filed: May 31, 2024

(65) Prior Publication Data

US 2025/0369664 A1 Dec. 4, 2025

(51) Int. Cl.

*F25B 39/04* (2006.01)
*F25B 41/20* (2021.01)
*F28F 27/02* (2006.01)

(52) U.S. Cl.

CPC ..... *F25B 39/04* (2013.01); *F25B 41/20* (2021.01); *F28F 27/02* (2013.01); *F28F 2250/06* (2013.01)

(58) Field of Classification Search

CPC . F25B 39/04; F25B 41/20; F28F 27/02; F28F 2250/06; F01D 25/02; F02C 3/22; F02C 7/16; F02C 7/224; F02C 3/305; F05D 2260/213

See application file for complete search history.

(56) References Cited

U.S. PATENT DOCUMENTS 4,352,273 A 10/1982 Kinsell et al.
5,628,183 A * 5/1997 Rice ..... F22B 1/1815 122/7 B
7,086,239 B2 8/2006 Haas et al.
11,635,022 B1 * 4/2023 Terwilliger ..... F02C 7/12 60/775
11,808,209 B1 11/2023 Sobanski
12,180,893 B2 * 12/2024 Terwilliger ..... F02C 7/141
12,286,907 B2 * 4/2025 Terwilliger ..... F01K 23/10
2019/0153952 A1 * 5/2019 Niergarth ..... F02C 7/14
2019/0257247 A1 * 8/2019 Pal ..... F02C 7/18
2020/0165982 A1 * 5/2020 Smith ..... F02K 3/115
2021/0340908 A1 * 11/2021 Boucher ..... F02C 7/224
2023/0374911 A1 11/2023 Terwilliger et al.
2024/0011417 A1 * 1/2024 Sibbach ..... F01D 21/12

FOREIGN PATENT DOCUMENTS

DE 10144841 B9 * 10/2004 ..... F03G 6/067
JP 2009156033 A * 7/2009
WO 2022232828 A1 11/2022

OTHER PUBLICATIONS

European Search Report dated Oct. 17, 2025, in connection with European Patent Application No. 25180233.6 , 9 pages.

* cited by examiner

*Primary Examiner* — Matthew T Largi

(57) ABSTRACT

An apparatus includes a cryo-fuel tank, at least two heat exchangers, at least one valve, and a condenser. The cryo-fuel tank is configured to store cryo-fuel. The at least two heat exchangers are configured to reduce heat of a core flow through an engine, where the at least two heat exchangers have different heat transfer efficiencies. The at least one valve is configured to control the core flow between each of the at least two heat exchangers. The condenser is configured to exchange heat between the cryo-fuel and the core flow processed through the at least two heat exchangers.

20 Claims, 1 Drawing Sheet

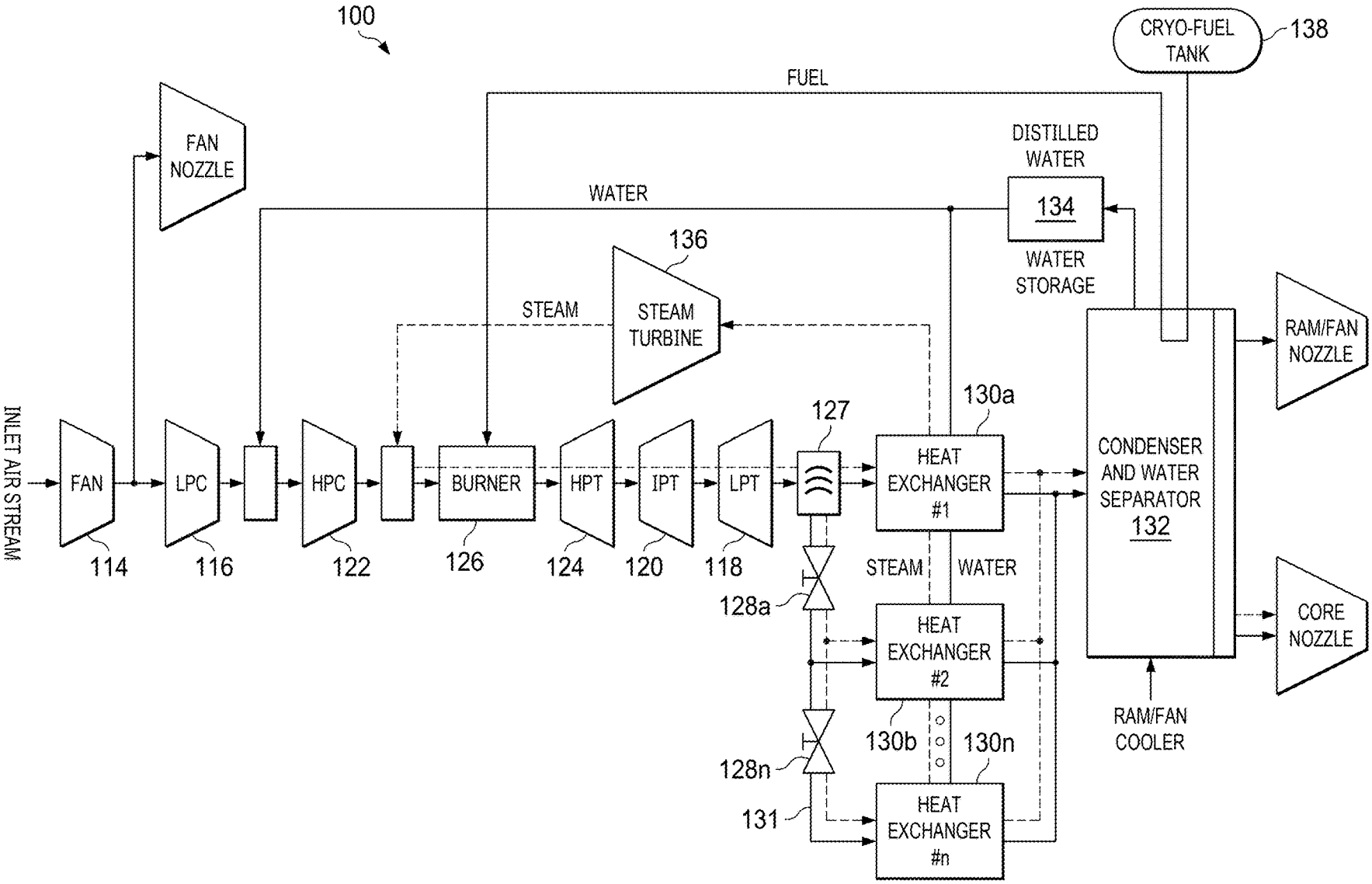
100
138
CRYO-FUEL TANK
FUEL
WATER
DISTILLED WATER
134
WATER STORAGE
RAM/FAN NOZZLE
CORE NOZZLE
CONDENSER AND WATER SEPARATOR
132
RAM/FAN COOLER
130a
HEAT EXCHANGER #1
WATER
STEAM
HEAT EXCHANGER #2
130b
130n
HEAT EXCHANGER #n
127
128a
128n
131
118
LPT
120
IPT
124
HPT
126
BURNER
136
STEAM TURBINE
STEAM
122
HPC
116
LPC
114
FAN
FAN NOZZLE
INLET AIR STREAM

DEICING AND ICING PREVENTION SYSTEM FOR ADVANCE CYCLE CONDENSERS

TECHNICAL FIELD

This disclosure relates generally to gas turbine engines. More specifically, this disclosure relates to a deicing and icing prevention system for advance cycle condensers.

BACKGROUND

In heat exchangers that intend to capture low-grade heat, a risk exists during transients where a condenser may freeze. While a deceleration of a throttle reduces heat coming from an engine core due to reduced combustion and flow, the condenser itself does not immediately react due to a time delay associated with the heat exchanger reaching a new thermal equilibrium at the new operating condition. Effectively, the condenser may be too cold right after deceleration and before the new operating point's thermal equilibrium is reached, resulting in the risk of freezing and back-pressuring the core flow path.

SUMMARY

This disclosure provides a deicing and icing prevention system for advance cycle condensers.

In a first embodiment, an apparatus includes a cryo-fuel tank, at least two heat exchangers, at least one valve, and a condenser. The cryo-fuel tank is configured to store cryo-fuel. The at least two heat exchangers are configured to reduce heat of a core flow through an engine, where the at least two heat exchangers have different heat transfer efficiencies. The at least one valve is configured to control the core flow between each of the at least two heat exchangers. The condenser is configured to exchange heat between the cryo-fuel and the core flow processed through the at least two heat exchangers.

In some embodiments, the at least two heat exchangers include a first heat exchanger and a second heat exchanger, and the at least one valve is configured to provide a first portion of the core flow to the first heat exchanger and a second portion of the core flow to the second heat exchanger.

In some embodiments, the at least one valve is able to completely divert the core flow to a less-efficient heat exchanger of the at least two heat exchangers.

In some embodiments, the apparatus further includes a bypass path configured to route the core flow to avoid the at least two heat exchangers.

In some embodiments, the bypass path includes an additional heat exchanger with a lower efficiency than the at least two heat exchangers.

In some embodiments, the apparatus further includes a valve configured to control the core flow to the bypass path.

In some embodiments, the at least two heat exchangers are arranged in order of decreasing efficiency.

In some embodiments, the at least two heat exchangers include a first heat exchanger, a second heat exchanger, and a third heat exchanger, and the first heat exchanger, the second heat exchanger, and the third heat exchanger are arranged in order of decreasing heat transfer efficiency.

In some embodiments, the at least one valve includes (i) a first valve configured to control the core flow between the first heat exchanger and the second heat exchanger and (ii) a second valve configured to control the core flow between the second heat exchanger and the third heat exchanger.

In some embodiments, the at least one valve includes (i) a first valve configured to control the core flow between the first heat exchanger and the second heat exchanger and (ii) a second valve configured to control the core flow between the first heat exchanger and the third heat exchanger.

In a second embodiment, an engine includes a fan, at least one compressor, at least one turbine, a cryo-fuel tank, at least two heat exchangers, at least one valve, and a condenser. The fan is configured to generate a core flow. The at least one compressor is configured to compress the core flow. The at least one turbine is configured to reduce the core flow. The cryo-fuel tank is configured to store cryo-fuel. The at least two heat exchangers are configured to reduce heat of the core flow passing through the at least one turbine, where the at least two heat exchangers have different heat transfer efficiencies. The at least one valve is configured to control the core flow between each of the at least two heat exchangers. The condenser is configured to exchange heat between the cryo-fuel and the core flow processed through the at least two heat exchangers.

In some embodiments, the at least two heat exchangers include a first heat exchanger and a second heat exchanger, and the at least one valve is configured to provide a first portion of the core flow to the first heat exchanger and a second portion of the core flow to the second heat exchanger.

In some embodiments, the at least one valve is able to completely divert the core flow to a less-efficient heat exchanger of the at least two heat exchangers.

In some embodiments, the engine further includes a bypass path configured to route the core flow to avoid the at least two heat exchangers.

In some embodiments, the bypass path includes an additional heat exchanger with a lower efficiency than the at least two heat exchangers.

In some embodiments, the engine further includes a valve configured to control the core flow to the bypass path.

In some embodiments, the at least two heat exchangers are arranged in order of decreasing efficiency.

In some embodiments, the at least two heat exchangers include a first heat exchanger, a second heat exchanger, and a third heat exchanger, and the first heat exchanger, the second heat exchanger, and the third heat exchanger are arranged in order of decreasing heat transfer efficiency.

In some embodiments, the at least one valve includes (i) a first valve configured to control the core flow between the first heat exchanger and the second heat exchanger and (ii) a second valve configured to control the core flow between the second heat exchanger and the third heat exchanger.

In some embodiments, the at least one valve includes (i) a first valve configured to control the core flow between the first heat exchanger and the second heat exchanger and (ii) a second valve configured to control the core flow between the first heat exchanger and the third heat exchanger.

Other technical features may be readily apparent to one skilled in the art from the following figures, descriptions, and claims.

BRIEF DESCRIPTION OF THE DRAWINGS

For a more complete understanding of this disclosure, reference is made to the following description, taken in conjunction with the accompanying drawings, in which:

The FIGURE illustrates an example engine in accordance with this disclosure.

DETAILED DESCRIPTION

The FIGURE, described below, and its various embodiments is used to describe the principles of the present disclosure are by way of illustration only and should not be construed in any way to limit the scope of this disclosure. Those skilled in the art will understand that the principles of the present disclosure may be implemented in any type of suitably arranged device or system.

As described above, in heat exchangers that intend to capture low-grade heat, a risk exists during transients where a condenser may freeze. While a deceleration of a throttle reduces heat coming from an engine core due to reduced combustion and flow, the condenser itself does not immediately react due to a time delay associated with the heat exchanger reaching a new thermal equilibrium at the new operating condition. Effectively, the condenser may be too cold right after deceleration and before the new operating point's thermal equilibrium is reached, resulting in the risk of freezing and back-pressuring the core flow path.

As described in more detail below, a bypass of an upstream heat exchanger allows for additional heat from the core to mitigate the risk of icing. This allows a hotter flow to mix with a flow already entering the condenser and moves water in exhaust gases further from the point of freezing.

The FIGURE illustrates an example gas turbine engine 100 in accordance with this disclosure. As shown in the FIGURE, the gas turbine engine 100 is disclosed that generally incorporates a fan 114, a first (or low) pressure compressor 116, a first (or low) pressure turbine 118, a second (or intermediate) pressure turbine 120, a second (or high) pressure compressor 122, a third (or high) pressure turbine 124, a combustor 126, a flow control 127, a plurality of valves 128*a*-128*n*, a plurality of heat exchangers 130*a*-130*n*, a condenser and fluid separator 132, a fluid storage 134, a steam turbine 136, and a cryo-fuel tank 138. Alternative engines might include an augmentor section among other systems or features. The fan 114 drives air along a bypass flow path in a bypass duct defined within a nacelle, while the compressors 116 and 122 drive air along a core flow path for compression and communication into the combustor 126 then expansion through the turbines 118, 120, and 124.

A low-speed shaft generally interconnects the fan 114 and the low-pressure turbine 118 (and the low-pressure compressor 116 in two-spool architectures). In some embodiments, the low-speed shaft can be connected to the fan 114 through a speed change mechanism (e.g., geared mechanism), which drives the fan 114 at a lower speed than the low-speed shaft 110. In other embodiments, the low-speed shaft can be configured to directly drive the fan 114. In three-spool architectures, such as that illustrated in the FIGURE, the intermediate-pressure turbine 120 couples to and is configured to drive the low-pressure compressor 116. A high-speed shaft can interconnect the high-pressure compressor 122 with the high-pressure turbine 124. A combustor 126 is arranged in the gas turbine engine 100 between the high-pressure compressor 122 and the high-pressure turbine 124. In some examples, a mid-turbine frame of the engine static structure is arranged generally between the high-pressure turbine 124 and the low-pressure turbine 118. The mid-turbine frame further supports bearing systems adjacent to the turbines 118, 120, and 124. The low-pressure compressor 116, the low-pressure turbine 118, the intermediate-pressure turbine 120, the high-pressure compressor 122, and the high-pressure turbine 124 may contain multiple stages.

The core airflow can be compressed by the low-pressure compressor 116 then the high-pressure compressor 122, mixed and burned with fuel in the combustor 126, then expanded over the high-pressure turbine 124, the intermediate-pressure turbine 120, and low-pressure turbine 118. The turbines 118, 120, and 124 rotationally drive the respective low-speed shaft and high-speed shaft in response to the expansion. It will be appreciated that each of the positions of the fan 114, the low-pressure compressor 116, the low-pressure turbine 118, the intermediate-pressure turbine 120, the high-pressure compressor 122, the high-pressure turbine 124, and the combustor 126 may be varied.

The flow control 127 and the valves 128*a*-128*n* can control the core flow through heat exchangers 130*a*-130*n*. A valve, as used herein, may be defined as any mechanism that allows for the control or distribution of flow, including but not limited to vanes (static or actuating), dampers, or baffles. The flow control 127 can be controlled to partially or fully control the flow path to the primary heat exchanger 130*a* and the valves 128*a*-128*n*. The valves 128*a*-128*n* can be controlled to partially or fully open a flow path to the heat exchangers 130*b*-130*n*. Each of the valves 128*a*-128*n* can be individually controlled. For example, a first valve 128*a* can be partially or fully opened while the last valve 128*n* is closed. The valves 128*a*-128*n* can be arranged in series or in parallel. Controlling the core flow through the different heat exchangers 130*a*-130*n* can allow for adjustments of the heat drawn from the core flow. If a condition occurs in which icing of the condenser is more likely, such as the speed of the engine is decreased, the valves 128*a*-128*n* can be controlled to guide the core flow to a heat exchanger 130 with a lowest heat transfer efficiency (e.g., a least efficient heat exchanger 130*n*).

In certain embodiments, while the valves 128*a*-128*n* are arranged in series, at least one valve 128*a*-128*n* can be positioned between each adjacent heat exchanger 130*a*-130*n*. For example, a first valve 128*a* can be positioned between the first heat exchanger 130*a* and the second heat exchanger 130*b* and an nth valve 128*n* can be positioned between the second heat exchanger 130*b* and the nth heat exchanger 130*n*. The valves 128*a*-128*n* can be controlled to close the flow path to a respective heat exchanger 130*a*-130*n*, allow fluid to pass through to a subsequent valves 128*b*-128*n*, and/or allow fluid to pass to a corresponding heat exchanger 130*b*-130*n*.

In certain embodiments, while the valves 128*a*-128*n* are arranged in parallel, at least one valve 128*a*-128*n* can be positioned between the first heat exchanger 130*a* and each of the remaining heat exchanger 130*b*-130*n*. For example, a first valve 128*a* can be positioned between the first heat exchanger 130*a* and a second heat exchanger 130*b* and an nth valve 128*n* can be positioned between the first heat exchanger 130*a* and the nth heat exchanger 130*n*. The valves 128*a*-128*n* can be controlled to close the fluid flow path to each specific heat exchanger 130*b*-130*n* and partially or fully opened to each specific heat exchanger 130*b*-130*n*.

In some embodiments, the least efficient heat exchanger 130*n* can be positioned on a bypass path 131. In certain embodiments, the least efficient heat exchanger 130*n* is simply a pipe of the bypass path 131. The bypass path 131 can be used when the heat of the core flow is low enough such that any heat removal ahead of the condenser would cause the flow to be below a threshold that would cause icing of the condenser and fluid separator 132.

The core flow processed through the heat exchangers 130*a*-130*n* can be output to the condenser and fluid separator 132. The condenser and fluid separator 132 can extract "low-grade" heat, or the heat of condensation, from the core flow processed by the heat exchangers 130*a*-130*n*. The fluid can be condensed in the condenser and fluid separator 132. The fluid recovered in the condenser and fluid separator 132 can be output to the fluid storage 134. The cryo-fuel tank 138 can also exchange heat with the fluid in the condenser and fluid separator 132. The fluid can be output to the fluid storage 134.

The heat exchangers 130*a*-130*n* can receive fluid from a fluid storage 134 and output the fluid to a steam turbine 136. The fluid passed through the steam turbine 136 can be passed back through the heat exchangers 130*a*-130*n*. The fluid received from the fluid storage 134 can draw heat from the fluids that pass through the valves 128*a*-128*n*. In some embodiments, each subsequent heat exchanger 130*a*-130*n* can be designed to be less efficient (e.g., less heat transfer efficiency) than a previous heat exchanger. For example, the first heat exchanger 130*a* can have a highest efficiency, the second heat exchanger 130*b* can have a second highest efficiency, and the nth heat exchanger 130*n* can have a lowest (comparable) efficiency.

Although the FIGURE illustrates an example gas turbine engine 100 in accordance with this disclosure, various changes may be made to the FIGURE. For example, the gas turbine engine 100 is illustrated as a three-spool architecture. However, other architectures are contemplated herein, such as a two-spool architecture or the like. Additionally, the various components in the FIGURE may be combined, further subdivided, replicated, omitted, or rearranged and additional components may be added according to particular needs. In particular, the heat exchangers 130*a*-130*n* may include more or less than three heat exchangers.

It may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

The description in the present disclosure should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," or "controller" within a claim is understood and intended to refer to structures known to those skilled in the relevant art, as further modified or enhanced by the features of the claims themselves, and is not intended to invoke 35 U.S.C. § 112(f).

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An apparatus comprising:

a cryo-fuel tank configured to store cryo-fuel;

at least two heat exchangers configured to reduce heat of a core flow through an engine, wherein the at least two heat exchangers have different heat transfer efficiencies;

at least one valve configured to control the core flow between each of the at least two heat exchangers;

a condenser configured to exchange heat between the cryo-fuel and the core flow processed through the at least two heat exchangers; and a bypass path configured to route the core flow to avoid the at least two heat exchangers, wherein the bypass path includes an additional heat exchanger with a lower efficiency than the at least two heat exchangers.

2. The apparatus of claim 1, wherein:

the at least two heat exchangers comprise a first heat exchanger and a second heat exchanger; and the at least one valve is configured to provide a first portion of the core flow to the first heat exchanger and a second portion of the core flow to the second heat exchanger.

3. The apparatus of claim 1, wherein the at least one valve is able to completely divert the core flow to a less-efficient heat exchanger of the at least two heat exchangers.

4. The apparatus of claim 1, further comprising:

a valve configured to control the core flow to the bypass path.

5. The apparatus of claim 1, wherein the at least two heat exchangers are arranged in order of decreasing efficiency.

6. The apparatus of claim 1, wherein:

the at least two heat exchangers comprise a first heat exchanger, a second heat exchanger, and a third heat exchanger; and the first heat exchanger, the second heat exchanger, and the third heat exchanger are arranged in order of decreasing heat transfer efficiency.

7. The apparatus of claim 6, wherein the at least one valve comprises:

a first valve configured to control the core flow between the first heat exchanger and the second heat exchanger; and a second valve configured to control the core flow between the second heat exchanger and the third heat exchanger.

8. The apparatus of claim 6, wherein the at least one valve comprises:

a first valve configured to control the core flow between the first heat exchanger and the second heat exchanger; and a second valve configured to control the core flow between the first heat exchanger and the third heat exchanger.

9. An engine comprising:

a fan configured to generate a core flow;

at least one compressor configured to compress the core flow;

at least one turbine configured to extract work from the core flow;

a cryo-fuel tank configured to store cryo-fuel;

a first heat exchanger configured to reduce heat of the core flow passing through the at least one turbine;

a second heat exchanger configured to reduce heat of the core flow passing through the at least one turbine;

a third heat exchanger configured to reduce heat of the core flow passing through the at least one turbine;

at least one valve configured to control the core flow between each of the first, second and third heat exchangers, wherein the at least one valve comprises:

a first valve configured to control the core flow between the first heat exchanger and the second heat exchanger;

a second valve configured to control the core flow between the second heat exchanger and the third heat exchanger; and a condenser configured to exchange heat between the cryo-fuel and the core flow processed through the first, second and third heat exchangers.

10. The engine of claim 9, wherein:

the at least two heat exchangers comprise a first heat exchanger and a second heat exchanger; and the at least one valve is able to provide a first portion of the core flow to the first heat exchanger and a second portion of the core flow to the second heat exchanger.

11. The engine of claim 9, wherein the at least one valve is able to completely divert the core flow to a less-efficient heat exchanger of the at least two heat exchangers.

12. The engine of claim 9, further comprising:

a bypass path configured to route the core flow to avoid the at least two heat exchangers.

13. The engine of claim 12, wherein the bypass path includes an additional heat exchanger with a lower efficiency than the at least two heat exchangers.

14. The engine of claim 12, further comprising:

a valve configured to control the core flow to the bypass path.

15. The engine of claim 9, wherein the at least two heat exchangers are arranged in order of decreasing efficiency.

16. The engine of claim 9, wherein:

the first heat exchanger, the second heat exchanger, and the third heat exchanger are arranged in order of decreasing heat transfer efficiency.

17. The engine of claim 9, wherein the at least one valve comprises:

a third valve configured to control the core flow between the first heat exchanger and the third heat exchanger.

18. An apparatus comprising:

a cryo-fuel tank configured to store cryo-fuel;

at least three heat exchangers configured to reduce heat of a core flow through an engine, wherein the at least three heat exchangers have different heat transfer efficiencies;

at least one valve configured to control the core flow between each of the at least three heat exchangers, wherein the at least one valve comprises:

a first valve configured to control the core flow between a first pair heat exchangers;

a second valve configured to control the core flow between a second pair of heat exchangers; and a condenser configured to exchange heat between the cryo-fuel and the core flow processed through the at least three heat exchangers.

19. The engine of claim 18, further comprising:

a bypass path configured to route the core flow to avoid the at least two heat exchangers.

20. The engine of claim 19, wherein the bypass path includes an additional heat exchanger with a lower efficiency than the at least two heat exchangers.

* * * * *